United States Patent [19]

Nakanishi et al.

[11] Patent Number: 4,714,426

[45] Date of Patent: Dec. 22, 1987

[54] IGNITION SYSTEM FOR OIL BURNER

[75] Inventors: Yutaka Nakanishi, Kounan; Toshihiko Yamada, Aichi; Yuji Sanada, Aichi; Takashi Kawai, Aichi, all of Japan

[73] Assignee: Toyotomi Kogyo Co., Ltd., Aichi, Japan

[21] Appl. No.: 946,223

[22] Filed: Dec. 24, 1986

[30] Foreign Application Priority Data

Dec. 28, 1985 [JP] Japan ..... 60-204586[U]
Jun. 28, 1986 [JP] Japan ..... 61-99745[U]
Jun. 28, 1986 [JP] Japan ..... 61-99746[U]

[51] Int. Cl.[4] ..... F23Q 2/08
[52] U.S. Cl. ..... 431/132; 431/262; 126/96
[58] Field of Search ..... 431/261, 262, 129, 132; 126/96

[56] References Cited

U.S. PATENT DOCUMENTS 4,428,729 1/1984 Takino et al. ..... 431/262

FOREIGN PATENT DOCUMENTS 13226 6/1979 Japan .
26901 9/1979 Japan .

*Primary Examiner*—Carroll B. Dority, Jr.
*Attorney, Agent, or Firm*—Pollock, Vande Sande & Priddy

[57] ABSTRACT

An ignition system for oil burner capable of positively accomplishing ignition without operating a combustion cylinder construction and keeping ignition performance for a long period of time. The ignition system is constructed in a manner such that an ignition heater is operated at a level below the combustion cylinder construction and a closing door is actuated in synchronism with the ignition heater so that an ignition window may be opened only when the ignition heater is approached to a wick for ignition.

14 Claims, 7 Drawing Figures

IGNITION SYSTEM FOR OIL BURNER

BACKGROUND OF THE INVENTION

1. Field of the Invention

This invention relates to an ignition system for an oil burner, and more particularly to such an ignition system which is adapted to carry out ignition without operating a combustion cylinder construction.

2. Description of the Prior Art

A conventional ignition device for carrying out ignition without operating a combustion cylinder is constructed to accomplish ignition by means of an ignition wick. However, such construction needs maintenance of the ignition wick and readily ruins ignition performance of an oil burner due to deterioration of the ignition wick. In order to avoid such a disadvantage, an ignition device has been proposed which is adapted to directly ignite a combustion wick. Such an ignition device is disclosed in each of Japanese Utility Model Publication No. 13226/1979 and Japanese Utility Model Publication No. 26901/1979.

An ignition device disclosed in Japanese Utility Model Publication No. 13226/1979 is provided with an ignition window at an upper portion of an outer cylinder of a wick receiving construction of an oil burner. Unfortunately, the ignition device is not adapted to tightly close the ignition window by means of any cover means, accordingly, an ignition heater must be fixed to cover the ignition window. Such construction of the ignition device causes air necessary for ignition to be supplied through only a gap formed above a filament of the ignition heater. This fails to supply a sufficient amount of air, resulting in deterioration of ignition performance.

An ignition device disclosed in Japanese utility Model Publication No. 26901/1979 is so constructed that a rising wall is arranged above an outer cylinder of a wick receiving construction at a long distance from a combustion wick and formed with an ignition window through which an ignition heater is approached to the wick and which is adapted to be closed by a shutter. The ignition device permits air sufficient for ensuring satisfactory ignition performance to be supplied to the wick. However, it has an important disadvantage of causing an overall height of an oil burner to be significantly increased due to arrangement of the rising wall above the outer cylinder, to thereby fail to render the oil burner small-sized.

SUMMARY OF THE INVENTION

Accordingly, it is an object of the present invention to provide an ignition system for an oil burner which is capable of allowing ignition to be positively carried out in a simple manner without operating a combustion cylinder construction.

It is another object of the present invention to provide an ignition system for an oil burner which is capable of carrying out ignition at a position below a combustion cylinder construction to prevent an overall height of the oil burner from being increased.

It is a further object of the present invention to provide an ignition system for an oil bunrer which is capable of effectively keeping satisfactory ignition performance for a long period of time.

It is still another object of the present invention to provide an ignition system for an oil burner which is capable of providing the oil burner with a space sufficient to arrange various mechanisms therein.

It is yet another object of the present invention to provide an ignition window construction for an oil burner which is capable of allowing ignition to be carried out without operating a combustion cylinder construction.

It is still a further object of the present invention to provide an ignition window construction for an oil burner which is capable of tightly closing an ignition window except at the time of ignition.

It is yet a further object of the present invention to provide an ignition window construction for an oil burber which is capable of significantly improving ignition performance of the oil burner.

In accordance with the present invention, there is provided an ignition system for an oil burner which includes a wick arranged between outer and inner cylinders of a wick receiving construction and raised at an upper end portion thereof to a lower section of a combustion cylinder construction placed on the wick receiving construction.

The ignition system includes an ignition window provided at an upper region of the outer cylinder of the wick receiving construction. The ignition window is tightly closed by a closing door which is movably arranged opposite to the ignition window to operate it. The ignition system also includes a door actuating means for actuating the closing door to operate the ignition window and an actuation arm arranged so as to be pivotally movable and having an ignition heater mounted thereon so as to be approachable to the ignition window. The door actuation means are operatively connected to the actuation arm to actuate the closing door in synchronism with the actuation arm, to thereby open the ignition window when the ignition heater is approached to the ignition window. Pivotal movement of the actuation arm is regulated within a predetermined range by means of an actuation regulator to appropriately approach the ignition heater to the wick.

In accordance with the present invention, there is also provided an ignition window construction for an oil burner which includes a wick arranged between outer and inner cylinders of a wick receiving construction and raised at an upper end portion thereof to a lower portion of a combustion cylinder construction placed on the wick receiving construction. The ignition window construction includes an ignition window which is provided at an upper region of the outer cylinder of the wick receiving construction and tightly closed by a closing door. The closing door is movably arranged opposite to the ignition window to operate it. The ignition window construction also includes a door actuating means for actuating the closing door to operate the ignition window. The door actuating means actuates the closing door in synchronism with an ignition heater construction so as to open the ignition window when an ignition heater of the ignition heater construction is approached to the ignition window. Also, the door actuating means forces the closing door against the ignition window to tightly close the window.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designates like or corresponding parts throughout; wherein.

DETAILED DESCRIPTION OF THE PREFERRED EMBODIMENTS

Now, an ignition device for an oil burner according to the present invention will be described hereinafter with reference to the accompanying drawings.

Figure 1:
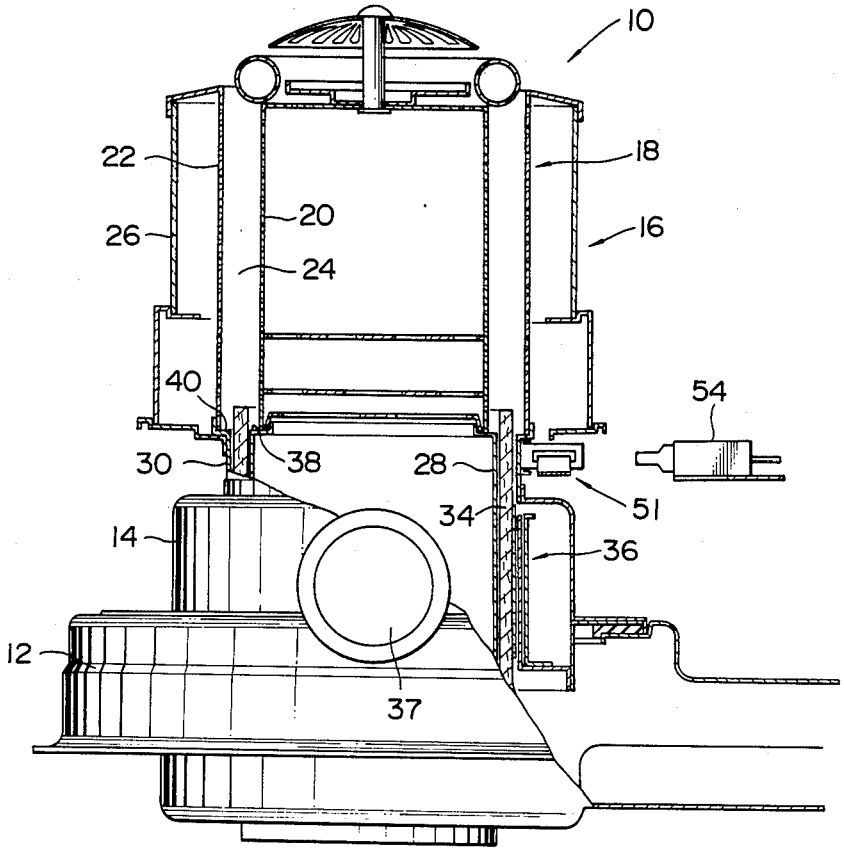
FIG. 1 is a partly vertical sectional view showing an example of an oil burner in which an ignition system according to the present invention is adapted to be incorporated.

FIG. 1 illustrates an example of an oil burner in which an ignition device according to the present invention is adapted to be incorporated. The oil burner generally designated by reference numeral 10 is in the form of a red-heated oil-fired space heater, however, it should be noted that an oil burner in which an ignition device of the present invention is to be employed is not limited to such a red-heated space heater.

Prior to describing an ignition device of the present invention, the oil burner illustrated in FIG. 1 will be briefly described.

The oil burner per se is constructed in a manner widely known in the art. The oil burner 10 includes an oil reservoir 12 for storing therein fuel oil such as kerosene, a wick receiving construction 14 positioned on the oil reservoir 12 and a combustion cylinder construction 16 arranged on the wick receiving construction 14. On the oil reservoir 12 is invertedly supported an oil tank (not shown) in a manner to be communicated with the oil reservoir to supply fuel oil therefrom to the reservoir 12.

The combustion cylinder construction 16 includes a double combustion cylinder 18 comprising an inner cylindrical member 20 and an outer cylindrical member 22 which are arranged to define a space 24 therein. The inner and outer cylindrical members 20 and 22 each are provided with a plurality of through-holes and red-heated during combustion operation of the oil burner. The combustion cylinder construction also includes a heat-permeable cylinder 26 which is arranged so as to be spaced from the outer cylindrical member 22 and serves to discharge heat rays emitted from the red-heated double combustion cylinder 18 therethrough to an exterior of the oil burner.

The wick receiving construction 14 includes an inner cylinder 28 and an outer cylinder 30 which are substantially concentrically arranged to define an space or chamber 32 (FIG. 2) for movably receiving a wick 34 therein. The wick receiving chamber 32 is formed so as to be communicated to the space 24 between the inner cylindrical member 20 and the outer cylindrical member 22 and the oil reservoir 12. When combustion is to be carried out, the wick 34 is raised at an upper end thereof to a lower end portion of the space 24 by means of a wick actuating mechanism which is generally indicated at reference numeral 36 in FIG. 1 and operated by a knob 37. The wick actuating mechanism 36 may be constructed in a manner widely known in the art. The wick 4 is constantly immersed at a lower portion thereof in fuel oil stored in the oil reservoir 12. The inner cylinder 28 is inwardly enlarged at an upper end to form a flange 38 on which the inner cylindrical member 20 of the double combustion cylinder 18 is supported. Likewise the outer cylinder 30 is formed at an upper end thereof with an outward flange 40 on which the outer cylindrical member 22 is supported.

Figure 2:
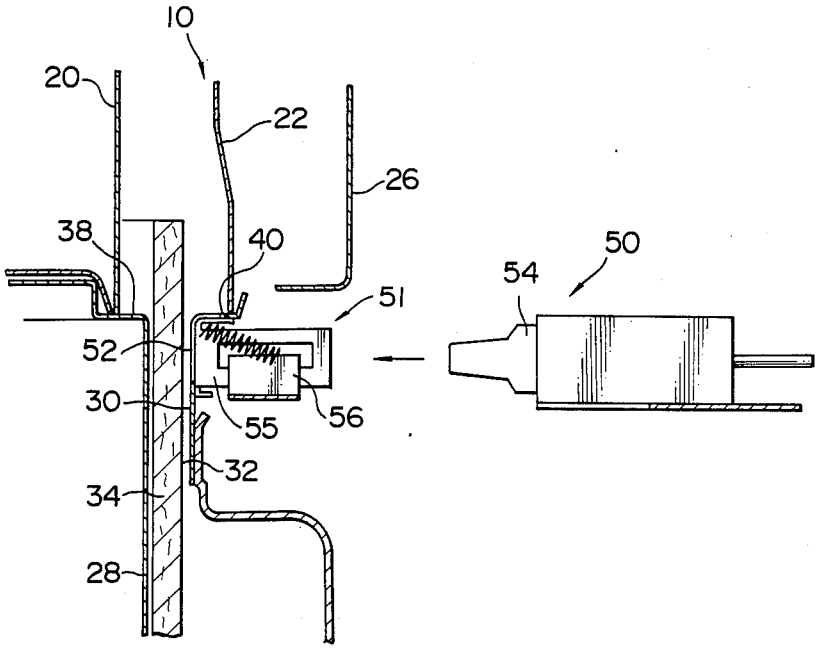
FIG. 2 is a sectional view showing a part of an embodiment of an ignition system according to the present invention.

An ignition device of the illustrated embodiment is arranged adjacent to an upper portion of the wick receiving chamber as generally indicated by reference numeral 50 in FIG. 2. The ignition system 50 of the illustrated embodiment is adapted to operate an ignition window by means of a closing door. More particularly, the ignition system 50 includes an ignition window construction generally designated by reference numeral 51 in FIGS. 1 to 4. The ignition window construction 51 includes an ignition window 52 formed at the outer cylinder 30 of the wick receiving chamber 32. The ignition window 52 is arranged at a position which allows an ignition heater 54 actuated in a manner described hereinafter to be approached to an upper end portion of the wick 34. In the illustrated embodiment, the ignition window 52 is formed at an upper section of the outer cylinder 30 extending from an upper portion of a cylindrical section of the outer cylinder 30 to the flange section 40 of the cylinder 30. Such arrangement allows the upward flow of air through the flange section 40 to be immediately formed, so that a flame formed by ignition may rise while being carried on the upward air flow to significantly improve ignition performance of the oil burner.

Figure 4:
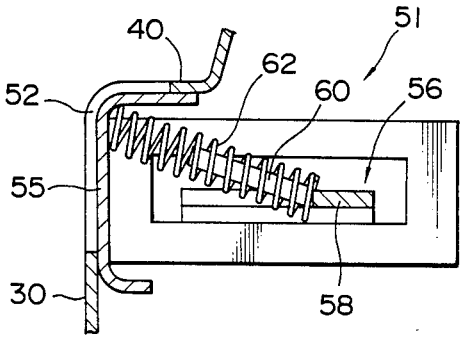
FIG. 4 is a sectional view showing an ignition window construction employed in the ignition system shown in FIG. 2.
Figure 3:
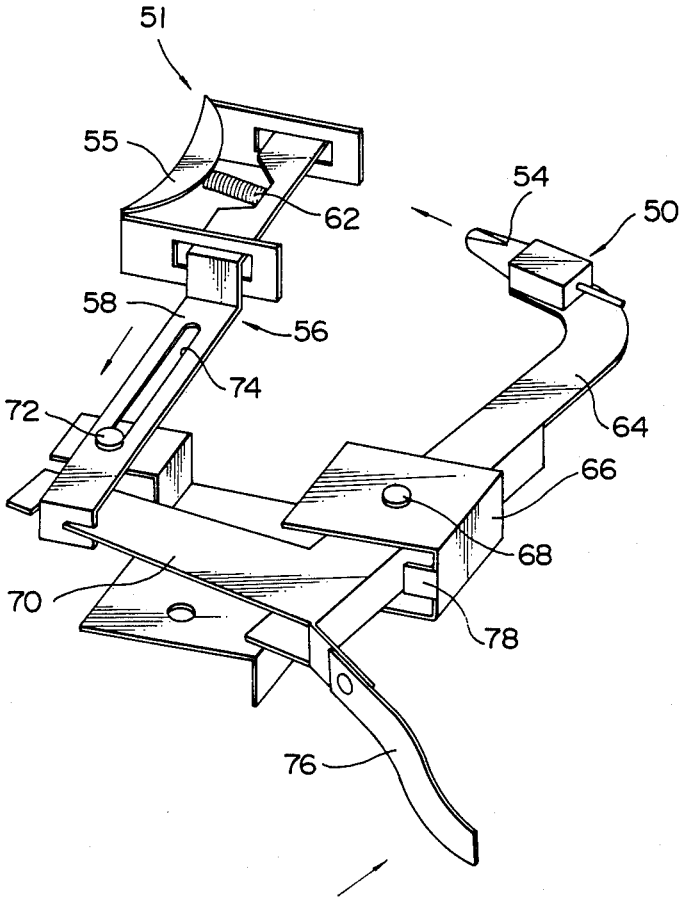
FIG. 3 is an enlarged perspective view showing the ignition system of FIG. 2.

The ignition window construction 51 also includes a closing door 55 which is actuated by means of a door actuating means or door actuator 56 to openably operate the ignition window 54. The door actuator 56 includes an actuator body 58 which, in the illustrated embodiment, is formed into an elongated plate-like shape, as shown in FIG. 3. The closing door 55 is movably mounted on the door actuator 56. In the illustrated embodiment, the door 55 is movably fitted at a base section thereof on one end portion of the actuator body so as to be movable in a direction substantially perpendicular to the body 58. The actuator body 58 is provided with a projection 60 extending toward a door body of the closing door 55. In the embodiment, the projection 60 is formed into a rod-like shape and arranged so as to obliquely upwardly extend toward the door body of the door 55, as shown in FIG. 4. On the rod-like projection 60 is loosely fitted a coiled spring 62 in a manner to be interposed between the projection 60 and the door body of the closing door 55. The spring 62 is supported at one end thereof on a base of the projection 60 and abutted at the other end thereof against the door body of the closing door 55 to constantly force the closing door in an obliquely upward direction. This results in the closing door 55 being pressed against the upper section of the outer cylinder 30, and more particularly, in the illustrated embodiment, the upper portion of the cylindrical section of the cylinder 30 and the flange section 40, so that the closing door may tightly close the ignition window 52.

The ignition system of the illustrated embodiment further includes an ignition heater construction which is provided with the above-described ignition heater 54. The ignition heater construction, as shown in FIG. 3, includes an actuation arm 64 pivotally mounted on a support member 66 of the oil burner through a pivot pin 68. The above-described ignition heater 54 is mounted on a distal end of the actuation arm 64, so that it may be approached to the wick 34 depending upon pivotal movement of the actuation arm 64. The actuation arm 64 is operatively connected to the door actuating means 56 of the ignition window construction 51 through a connection means 70, so that the door actuating means 56 and closing door 55 may be separated from the ignition window 52 depending upon pivotal movement of the actuation arm 64 as described hereinafter. In the illustrated embodiment, the connection means 70 is formed into a plate-like shape and integral with the actuation arm 64. The support member 66 of the oil burner is provided with a guide means or guide pin 72 and correspondingly the door actuating means is provided at the actuator body with an elongated guide groove 74 which is formed to extend in a longitudinal direction of the actuator body 58 and loosely fitted on the guide pin 72, so that the door actuating means 56 may be linearly reciprocated along the guide pin 72 depending upon pivotal movement of the actuation arm 64.

Figure 5:
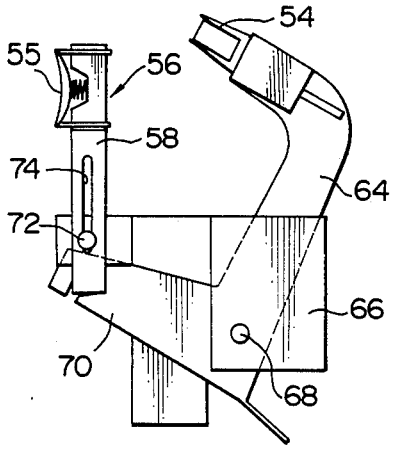
FIG. 5. is a plan view showing the manner of operation of the ignition system shown in FIG. 2 in which an actuation arm is kept away from a wick.
Figure 6:
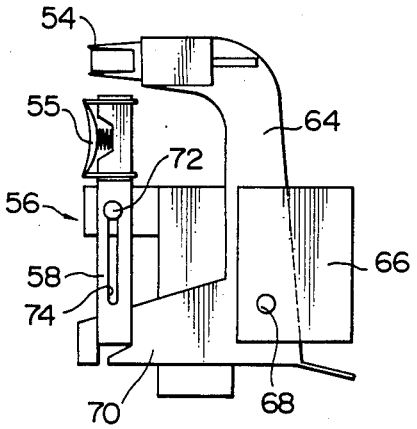
FIG. 6 is a plan view showing the manner of operation of the ignition system shown in FIG. 2 in which an actuation arm is approached to a wick for ignition.

The actuation arm 64 is pivotally moved by means of an operation means 76 such as a lever and pivotal movement of the actuation arm 64 is controlled by an actuation regulator 78. The regulator 78 may be provided at the actuation arm 64 or a portion of the oil burner positionally corresponding to the actuation arm 64. In the illustrated embodiment, the actuation regulator 78 is in the form of a projection and provided at the oil burner and more particularly at the support member 66 of the oil burner, so that the actuation arm 64 may be selectively abutted against the regulator 78, resulting in the pivotal movement being regulated within a predetermined range. Alternatively, a combination of the guide pin 72 and guide groove 74 may be used as the regulator. This eliminates the provision of an independent regulator such as the regulator 78 as shown in FIG. 3. More particularly, the illustrated embodiment may be so constructed that the pivotal movement of the actuation arm 64 about the pivot pin 68 is stopped when any end of the guide groove 74 is abutted against the guide pin 72 as shown in FIGS. 5 and 6. Accordingly, the action of the combination as the regulator is accomplished by merely appropriately determining a length of the guide groove 74.

In the illustrated embodiment, at least a part of the operation means 76 may comprise an elastic member such as a leaf spring. Such construction effectively prevents the regulator 78 from being deformed even when the operation lever 76 is operated with excessive power.

Now, the manner of operation of the illustrated embodiment described above will be described hereinafter with reference to FIGS. 1 to 6.

First, the wick 34 received in the wick receiving chamber 32 is raised at a tip end thereof to the lower portion of the space 24 between the inner cylindrical member 20 and the outer cylindrical member 22 by means of the knob 37 and wick actuating mechanism 36. Then, the actuation arm 64 is pivotally moved toward the outer cylinder 30 of the wick receiving construction 14 through the operation means 76 as indicated at an arrow in FIG. 3. This causes the connection means 70 to move the door actuating means 56 in a direction indicated at an arrow in FIG. 3, so that the closing door 55 may be separated from the ignition window 52 to open it. Then, the actuation arm 64 is further moved in the same direction to approach the ignition heater 54 to the wick 34 through the opened window 52, resulting in the wick 34 being ignited.

The positional relationship between the ignition heater 54 and the wick 34 substantially affects ignition performance of the oil burner. More particularly, not only excessive approach of the ignition heater to the wick but excessive separation of the former from the latter renders the ignition difficult. In order to avoid such a problem, the ignition system of the illustrated embodiment is provided with the regulator 78 which serves to keep the positional relationship constant to ensure the positive ignition.

When the actuation arm 64 is returned to its original position after the ignition, the ignition heater 54 is retracted from the wick and the door actuating means 56 is moved to cause the closing door 55 to tightly close the ignition window 52. Thus, combustion starts in the combustion cylinder construction 16. The combustion renders the double combustion cylinder 18 red-heated to a degree sufficient to emit heat rays therefrom, which are then discharged through the heat-permeable cylinder 26.

Figure 7:
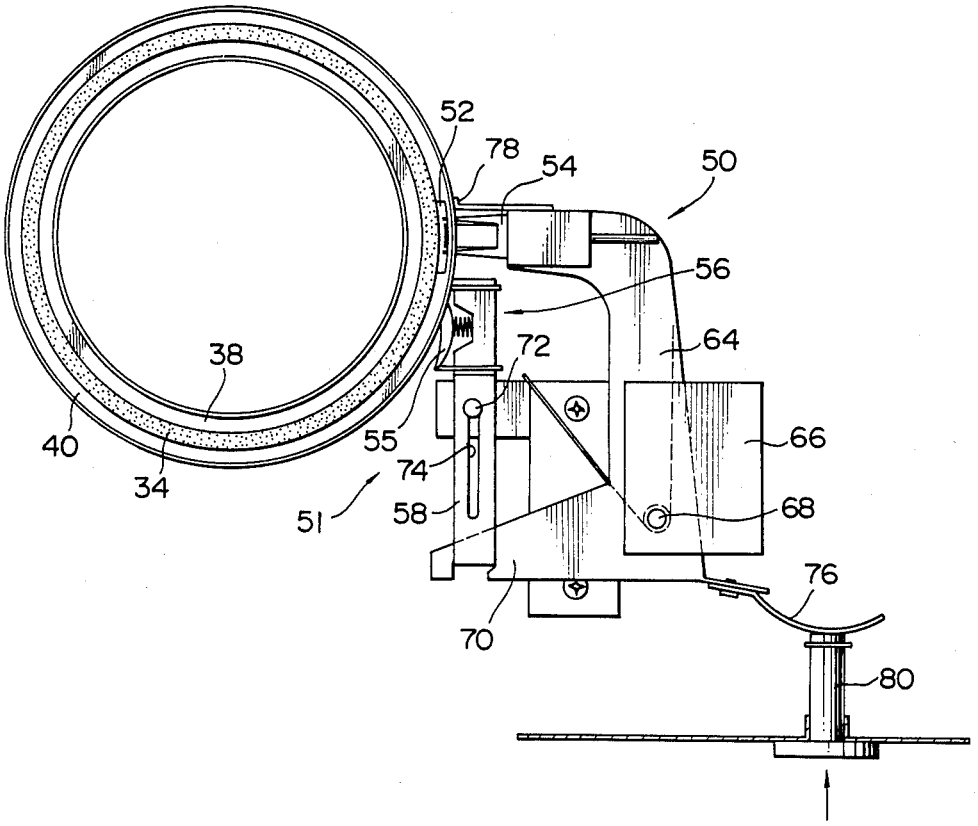
FIG. 7 is a plan view showing another embodiment of an ignition system for an oil burner according to the present invention.

FIG. 7 illustrates another embodiment of an ignition system according to the present invention. The embodiment of FIG. 7 is so constructed that an actuation regulator 78 is provided at a tip end of an actuation arm 64 in a manner to be adjacent to an ignition heater 54. Such construction causes the regulator 78 to be abutted against an outer cylinder of a wick receiving construction when an actuation arm 64 is pivotally actuated to move an ignition heater 54 toward a wick 34, resulting in the movement of the actuation arm 64 being appropriately regulated. In the embodiment, an operation means 76 is manually operated by means of a push button 80. Alternatively, it may be operated using any other suitable means such as a cam or the like. The remaining of the embodiment shown in FIG. 7 may be constructed in substantially the same manner as the embodiment described above.

As can be seen from the foregoing, the ignition window construction employed in the ignition system allows the ignition operation to be readily accomplished without moving or operating the combustion cylinder construction. Also, in the ignition window construction, the spring constantly forces the closing door in the obliquely upward direction so that the door may tightly close the window. Also, the formation of the ignition window at the upper section of the outer cylinder extending from the upper portion of the cylindrical section to the flange section results in the upward flow of air through the flange section. This causes a flame to immediately rise even when the ignition heater carries out ignition on a side portion of the wick, to thereby significantly improve ignition performance of the oil burner.

Also, the ignition system of the present invention is adapted to carry out ignition at a position below the combustion cylinder construction, to thereby prevent the overall height of the oil burner from being increased. Further, in the ignition system, the ignition heater, actuation arm, connection means and door actuating means may be arranged at substantially the same level, resulting in the oil burner being provided with a space sufficient to arrange a wick actuating mechanism, an automatic fire-extinguishing device and the like therein.

While preferred embodiments of the invention have been described with a certain degree of particularity with reference to the drawings, obvious modifications and variations are possible in the light of the above teachings. It is therefore to be understood that within the scope of the appended claims, the invention may be practiced otherwise than as specifically described.

What is claimed is:

1. An ignition system for an oil burner including a wick arranged between outer and inner cylinders of a wick receiving construction and raised at an upper end portion thereof to a lower portion of a combustion cylinder construction placed on said wick receiving construction, comprising:

an ignition window provided at an upper region of said outer cylinder of said wick receiving construction;

a closing door for tightly closing said ignition window, said closing door being movably arranged opposite to said ignition window;

a door actuating means for actuating said closing door;

an actuation arm arranged so as to be pivotally movable;

an ignition heater mounted on said actuation arm so as to be approachable to said ignition window;

a connection means for operatively connecting said actuation arm to said door actuating means to actuate said closing door in synchronism with said actuation arm, to thereby open said ignition window when said ignition heater is approached to said ignition window; and an actuation regulator for setting pivotal movement of said actuation arm within a predetermined range.

2. An ignition window construction as defined in claim 1, wherein said outer cylinder comprises a cylindrical section and an outward flange section formed at an upper end of said cylindrical section; and said ignition window is formed in a manner to extend from an upper portion of said cylindrical section to said outward flange section.

3. An ignition system as defined in claim 1 further comprising an operation means for pivotally moving said actuation arm.

4. An ignition system as defined in claim 3, wherein at least a part of said operation means comprises an elastic member.

5. An ignition system as defined in claim 1, wherein said door actuating means constantly forces said closing door against said ignition window.

6. An ignition system as defined in claim 1, wherein said actuation regulator comprises a projection arranged at a position which causes said projection to be abutted against said actuation arm to stop pivotal movement of said actuation arm.

7. An ignition system as defined in claim 1, wherein said actuation regulator comprises a guide pin-guide groove combination arranged to regulate movement of said door actuating means within a predetermined range, to thereby stop pivotal movement of said actuation arm through said connection means due to abutment between said guide pin and said guide groove.

8. An ignition system as defined in claim 7, said guide pin is provided at a burner body of said oil burner and said guide groove is formed at said door actuating means and loosely fitted on said guide pin.

9. An ignition system as defined in claim 1, wherein said actuation regulator is provided at a position of said actuation arm which causes said actuation regulator to be abutted against said outer cylinder to stop pivotal movement of said actuation arm.

10. An ignition system for an oil burner including a wick arranged between outer and inner cylinders of a wick receiving construction and raised at an upper end portion thereof to a lower portion of a combustion cylinder construction placed on said wick receiving construction, comprising:

an ignition window provided at an upper region of said outer cylinder extending from an upper portion of a cylindrical section of said outer cylinder to an outward flange formed at an upper end of said outer cylinder;

a closing door for tightly closing said ignition window, said closing door being movably arranged opposite to said ignition window to operate said ignition window;

a door actuating means for actuating said closing door to operate said ignition window, said door actuating means forcing said closing door against said ignition window in an obliquely upward direction;

an actuation arm arranged so as to be pivotally movable;

an ignition heater mounted on said actuation arm so as to be approachable to said ignition window;

a connection means for operatively connecting said actuation arm to said door actuating means to actuate said closing door in synchronism with said actuation arm, to thereby open said ignition window when said ignition heater is approached to said ignition window; and an actuation regulator for setting pivotal movement of said actuation arm within a predetermined range.

11. An ignition window construction for an oil burner which includes a wick arranged between outer and inner cylinders of a wick receiving construction and raised at an upper end portion thereof to a lower portion of a combustion cylinder construction placed on said wick receiving construction, comprising:

an ignition window provided at an upper region of said outer cylinder of said wick receiving construction;

a closing door for tightly closing said ignition window, said closing door being movably arranged opposite to said ignition window to operate said ignition window; and a door actuating means for actuating said closing door;

said door actuating means actuating said closing door in synchronism with an ignition heater construction so as to open said ignition window when an ignition heater of said ignition heater construction is approached to said ignition window;

said door actuation means adapted to force said closing door against said ignition window.

12. An ignition window construction as defined in claim 11, wherein said outer cylinder comprises a cylindrical section and an ouyward flange section formed at an upper end of said cylindrical section; and said ignition window is formed in a manner to extend from an upper portion of said cylindrical section to said outward flange section.

13. An ignition window construction as defined in claim 11, wherein said door actuating means forces said closing door against said ignition window in an obliquely upward direction.

14. An ignition window constuction as deifined in claim 13, wherein said closing door is forced against said ignition window by means of a spring interposed between said closing door and said door actuating means.

* * * * *